US010347399B2

(12) United States Patent
Kaczmarski et al.

(10) Patent No.: US 10,347,399 B2
(45) Date of Patent: Jul. 9, 2019

(54) M-JACKET FOR A TELECOMMUNICATIONS CABLE

(71) Applicant: Sterlite Technologies Limited, Aurangabad (IN)

(72) Inventors: Andrew Kaczmarski, Casula (AU); Darshana Bhatt, Aurangabad (IN); Pathakullah Allabakash, Aurangabad (IN)

(73) Assignee: STERLITE TECHNOLOGIES LIMITED, Aurangabad, MH (IN)

( * ) Notice: Subject to any disclaimer, the term of this patent is extended or adjusted under 35 U.S.C. 154(b) by 0 days.

(21) Appl. No.: 16/056,700

(22) Filed: Aug. 7, 2018

(65) Prior Publication Data

US 2019/0051433 A1 Feb. 14, 2019

(30) Foreign Application Priority Data

Aug. 8, 2017 (IN) ..... 201721028177

(51) Int. Cl.

| | |
|---|---|
| ***H01B 7/00*** | (2006.01) |
| ***H01B 11/08*** | (2006.01) |
| ***H01B 11/06*** | (2006.01) |
| ***H01B 3/44*** | (2006.01) |
| ***H01B 7/02*** | (2006.01) |
| ***H01B 7/295*** | (2006.01) |
| *H01B 7/18* | (2006.01) |

(52) U.S. Cl.

CPC ..... *H01B 11/08* (2013.01); *H01B 3/441* (2013.01); *H01B 7/02* (2013.01); *H01B 7/295* (2013.01); *H01B 11/06* (2013.01); *H01B 7/184* (2013.01); *H01B 7/185* (2013.01)

(58) Field of Classification Search

USPC ..... 174/110 R, 113 R, 113 C, 115, 116

See application file for complete search history.

(56) References Cited

U.S. PATENT DOCUMENTS

| | | | | |
|---|---|---|---|---|
| 5,796,046 A * | 8/1998 | Newmoyer | ..... | H01B 7/184 174/113 AS |
| 2007/0144763 A1* | 6/2007 | Park | ..... | H01B 11/06 174/113 C |
| 2011/0168426 A1* | 7/2011 | Kim | ..... | H01B 11/04 174/113 C |

* cited by examiner

*Primary Examiner* — William H. Mayo, III

(57) ABSTRACT

An M-jacket for use in a telecommunications cable including a jacket body. The jacket body extends along a longitudinal axis of the telecommunications cable. The longitudinal axis passes through a geometrical center of the telecommunications cable. The jacket body includes a first surface. The first surface surrounds a core region of the telecommunications cable. The first surface defines a plurality of first grooves extending radially outwardly from the longitudinal axis of the telecommunications cable and a plurality of second grooves extending radially outwardly from the longitudinal axis of the telecommunications cable. The plurality of second grooves is disposed at an interstitial position between the plurality of first grooves. In addition, the jacket body includes a second surface. The second surface extends along the longitudinal axis of the telecommunications cable and disposed in a spaced relation to the first surface.

10 Claims, 1 Drawing Sheet

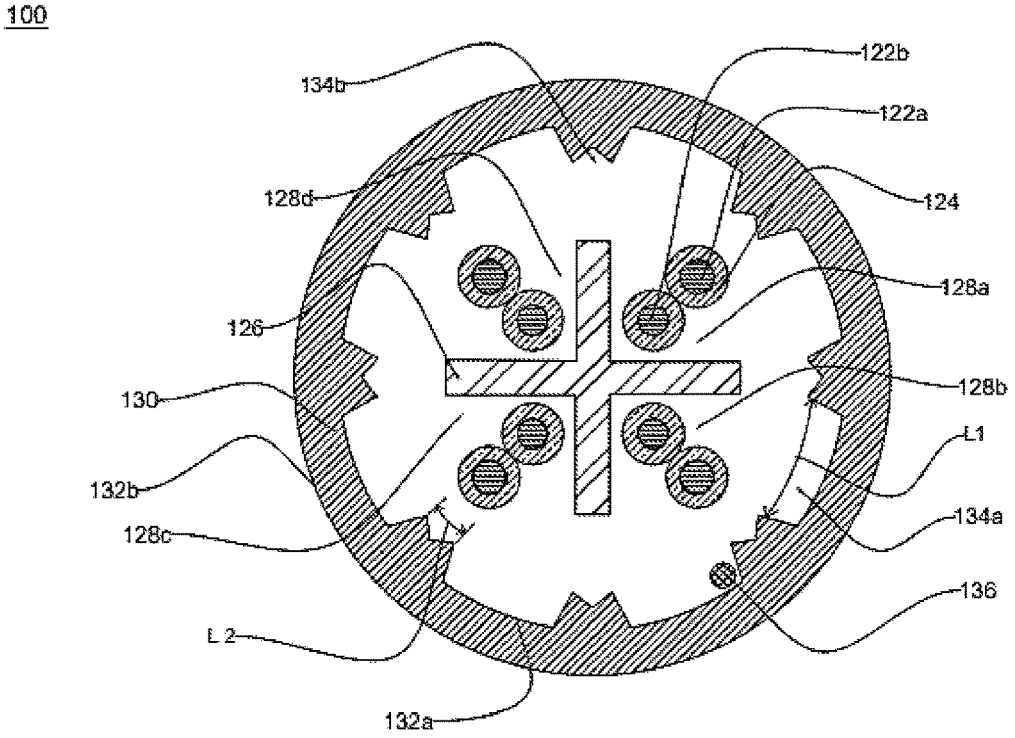
100
134b
122b
122a
128d
124
128a
126
128b
130
L1
132b
134a
128c
136
L 2
132a

M-JACKET FOR A TELECOMMUNICATIONS CABLE

TECHNICAL FIELD

The present disclosure relates to the field of telecommunication cables. More particularly, the present disclosure relates to a jacket for a telecommunications cable for high speed data transmission applications. The present application is based on, and claims priority from an Indian Application Number 201721028177, filed on 8 Aug. 2017 the disclosure of which is hereby incorporated by reference herein.

BACKGROUND

With an increase in utilization of complex communication and networking systems, the demand for transmitting signals at high transmission rates has increased. In order to meet the growing demands, various types of data transmission cables are used for transmitting data which are compliant with high performance data standards. These data transmission cables are classified into UTP (Unshielded Twisted Pair) cables, FTP (Foiled Twisted Pair) cables and STP (Shielded Twisted Pair) cables depending on the shield. UTP cable is the widely used data transmission cable in which one or more twisted pairs of insulated conductors are bundled within an outer jacket. Typically, the one or more twisted pairs of insulated conductors along with other components like separators, ripcords etc. defines a cable core of the data transmission cable. The cable core is surrounded by the outer jacket extruded circumferentially over the cable core to provide mechanical strength and protection to the cable core.

A common problem in the telecommunications cable is an increased occurrence of an alien crosstalk associated with high speed signal transmission especially for augmented categories such as Cat 6A, Cat 7A and Cat 8. In general, alien crosstalk is an electromagnetic noise that occurs in a data transmission cable which runs alongside one or more other data transmission cables. Alien crosstalk is an important factor in evaluating telecommunication cable performance as it represents signal energy loss or dissipation due to coupling between conductors or components of the telecommunication cable. The alien crosstalk causes interference to the information transmitted through the data transmission cable. In addition, the alien crosstalk reduces the data transmission rate and can also cause an increase in the bit error rate. The prior arts have tried to come up with several cable design solutions to minimize the alien crosstalk. In one of the prior art with patent number WO2007103507 A2, a telecommunications cable is provided. The telecommunications cable includes an inner jacket and an outer jacket for housing a plurality of twisted pairs of insulated conductors. In addition, the inner jacket and outer jacket includes a plurality of channels formed on inner surface. The telecommunication cable employs excess material for the jacket.

In light of the above stated discussion, there exists a need for a telecommunications cable which overcomes the above cited drawbacks of conventionally known telecommunications cable.

OBJECT OF THE INVENTION

A primary object of the disclosure is to provide a M-jacket with grooves for telecommunications cable.

Another object of the present disclosure is to provide the telecommunications cable with reduced alien cross talk.

Yet another object of the present disclosure is to provide the telecommunications cable with reduced jacket material consumption.

Yet another object of the present disclosure is to provide the telecommunications cable with improved electrical performance.

SUMMARY

In a first example, a jacket for use in a telecommunications cable is provided. The jacket includes a jacket body. The jacket body extends along a longitudinal axis of the telecommunications cable. The longitudinal axis passes through a geometrical center of the telecommunications cable. The jacket body includes a first surface. The first surface surrounds a core region of the telecommunications cable. The first surface defines a plurality of first grooves extending radially outwardly from the longitudinal axis of the telecommunications cable and a plurality of second grooves extending radially outwardly from the longitudinal axis of the telecommunications cable. The plurality of second grooves is disposed at an interstitial position between the plurality of first grooves. Each of the plurality of first grooves is defined by a first circumferential arc length in a range of about 1 millimeter to 6 millimeters. The interstitial position between the pluralities of first grooves is defined by a second circumferential arc length in a range of about 0.2 millimeters to 2 millimeters. Each of the plurality of first grooves has a radial thickness in a range of about 0.3 millimeters to 1 millimeter. The radial distance between the pointed edges of the plurality of first grooves and the plurality of second grooves and the second surface lies in a range of about 0.4 millimeter to 1.8 millimeters. In addition, the jacket body includes a second surface. The second surface extends along the longitudinal axis of the telecommunications cable and disposed in a spaced relation to the first surface. The second surface is disposed at a radially outwardly position and at a radial distance of at least 0.3 millimeters from the first surface. The jacket is made of a material selected from a group. The group consists of polyvinyl chloride, polyolefin, low smoke zero halogen, low smoke flame retardant zero halogen and thermoplastic polyurethane.

In an embodiment of the present disclosure, the jacket has a first diameter in a range of about 4 millimeters to 8 millimeters.

In an embodiment of the present disclosure, the jacket has a second diameter in a range of about 5 millimeters to 9 millimeters.

In an embodiment of the present disclosure, the plurality of first grooves has a cross-sectional shape selected from a group. The group consists of sinusoidal, semicircular, square, rectangular, trapezoidal and arched.

In an embodiment of the present disclosure, the plurality of second grooves has a M shape.

In an embodiment of the present disclosure, the plurality of first grooves arranged around the first surface is in a number range of about 3 to 12.

In an embodiment of the present disclosure, the plurality of second grooves arranged around the first surface is in a number range of about 3 to 12.

In a second example, a telecommunications cable is provided. The telecommunications cable includes a plurality of twisted pairs of insulated conductors. The plurality of twisted pairs of insulated conductors extends substantially along a longitudinal axis of the telecommunications cable. Each of the plurality of twisted pairs of insulated conductors includes an electrical conductor. The electrical conductor extends along the longitudinal axis of the telecommunications cable. The telecommunications cable includes an insulation layer. The insulation layer surrounds the electrical conductor. The insulation layer extends along the longitudinal axis of the telecommunications cable. The telecommunications cable includes a separator. The separator separates each twisted pair of insulated conductor of the plurality of twisted pairs of insulated conductors. The separator extends along the longitudinal axis of the telecommunications cable. The telecommunications cable includes a jacket. The jacket includes a jacket body. The jacket body extends along a longitudinal axis of the telecommunications cable. The longitudinal axis passes through a geometrical center of the telecommunications cable. The jacket body includes a first surface. The first surface surrounds a core region of the telecommunications cable. The first surface defines a plurality of first grooves extending radially outwardly from the longitudinal axis of the telecommunications cable and a plurality of second grooves extending radially outwardly from the longitudinal axis of the telecommunications cable. The plurality of second grooves is disposed at an interstitial position between the plurality of first grooves. Each of the plurality of first grooves is defined by a first circumferential arc length in a range of about 1 millimeter to 6 millimeters. The interstitial position between the pluralities of first grooves is defined by a second circumferential arc length in a range of about 0.2 millimeters to 2 millimeters. Each of the plurality of first grooves has a radial thickness in a range of about 0.3 millimeters to 1 millimeter. The radial distance between the pointed edges of the plurality of first grooves and the plurality of second grooves and the second surface lies in a range of about 0.4 millimeter to 1.8 millimeters. In addition, the jacket body includes a second surface. The second surface extends along the longitudinal axis of the telecommunications cable and disposed in a spaced relation to the first surface. The second surface is disposed at a radially outwardly position and at a radial distance of at least 0.3 millimeters from the first surface. The jacket is made of a material selected from a group. The group consists of polyvinyl chloride, polyolefin, low smoke zero halogen, low smoke flame retardant zero halogen and thermoplastic polyurethane.

In an embodiment of the present disclosure the telecommunications cable includes, one or more ripcords placed inside the core of the telecommunications cable. The one or more ripcords lie substantially along the longitudinal axis of the telecommunications cable. The one or more ripcords facilitate stripping of the jacket.

In an embodiment of the present disclosure, the insulation layer is made of a material selected from a group. The group consists of polypropylene, polyolefin, foamed polyolefin, foamed polypropylene and fluoro-polymer.

In an embodiment of the present disclosure, the separator is made of a material selected from a group. The group consists of polyolefin, foamed polyolefin, polypropylene, foamed polypropylene, LSZH and flame retardant polyvinyl chloride.

BRIEF DESCRIPTION OF FIGURES

Having thus described the disclosure, in general, terms, reference will now be made to the accompanying figures, wherein:

FIG. 1 illustrates a cross sectional view of a telecommunications cable, in accordance with an embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

In the following description, for purposes of explanation, numerous specific details are set forth in order to provide a thorough understanding of the present technology. It will be apparent, however, to one skilled in the art that the present technology can be practiced without these specific details. In other instances, structures and devices are shown in block diagram form only in order to avoid obscuring the present technology.

Reference in this specification to "one embodiment" or "an embodiment" means that a particular feature, structure, or characteristic described in connection with the embodiment is included in at least one embodiment of the present technology. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Moreover, although the following description contains many specifics for the purposes of illustration, anyone skilled in the art will appreciate that many variations and/or alterations to said details are within the scope of the present technology. Similarly, although many of the features of the present technology are described in terms of each other, or in conjunction with each other, one skilled in the art will appreciate that many of these features can be provided independently of other features. Accordingly, this description of the present technology is set forth without any loss of generality to, and without imposing limitations upon, the present technology.

FIG. 1 illustrates a cross sectional view of a telecommunications cable 100, in accordance with an embodiment of the present disclosure. In general, the telecommunications cable 100 is a media that allows baseband transmissions from a transmitter to a receiver. The telecommunications cable 100 is used for a wide variety of applications. The wide variety of applications include recording studios, data transmission, radio transmitters, intercoms, electronic circuit installations and the like. Moreover, the telecommunications cable 100 is used for high speed data rate transmission. The high speed data rate transmission includes 1000BASE-T (Gigabit Ethernet) and 10 GBASE-T (10-Gigabit Ethernet) or other standards. The telecommunications cable 100 is a shielded or unshielded twisted pair telecommunications cable. In general, the unshielded twisted pair telecommunications cable is a cable with two conductors of a single circuit twisted together. The electrical conductors are twisted together for the purposes of canceling out electromagnetic interference from external sources. The telecommunications cable 100 is associated with a longitudinal axis (not shown in figure). The longitudinal axis of the telecommunications cable 100 passes through a geometrical center of the cross section of the telecommunications cable 100. The telecommunications cable 100 is a Category 6A cable or higher categories. In an embodiment of the present disclosure, the telecommunications cable 100 is a Category 6 cable.

Further, the telecommunications cable 100 includes a plurality of twisted pairs of insulated conductors, a separator 126, plurality of area sections 128*a-d* and a M-jacket 130. In addition, the telecommunications cable 100 includes a first surface 132*a*, a second surface 132*b*, a plurality of first grooves 134*a*, a plurality of second grooves 134*b* and a ripcord 136. In addition, the plurality of twisted pairs of insulated conductors includes more pairs of twisted insulated conductors (not numbered). The above combination of structural elements enables an improvement in a plurality of characteristics of the telecommunications cable 100. The plurality of characteristics includes electrical properties and transmission characteristics. The electrical properties include input impedance, conductor resistance, mutual capacitance, resistance unbalance, capacitance unbalance, propagation delay and delay skew. The transmission characteristics include attenuation, return loss, near end crosstalk, attenuation to crosstalk ratio far end, alien cross talk, power sum attenuation to crosstalk ratio at far end and Transverse Conversion Loss (TCL).

In general, the input impedance is the ratio of the amplitudes of voltage and current of a wave travelling in one direction in the absence of reflections in the other direction. In an embodiment of the present disclosure, the input impedance of the telecommunications cable 100 is 100 ohm±15 ohm. In another embodiment of the present disclosure, the telecommunications cable 100 has any other suitable value of characteristic impedance. In general, the conductor Resistance is an electrical quantity that measures how the device or material reduces the electric current flow through it. In an embodiment of the present disclosure, the conductor resistance of the telecommunications cable 100 is less than or equal to 9.38 ohm per 100 meters at 20° C. In another embodiment of the present disclosure, the telecommunications cable 100 has any other suitable value of the conductor resistance.

In general, the mutual capacitance is intentional or unintentional capacitance taking place between two charge-holding objects or conductors in which the current passing through one passes over into the other conductor. In an embodiment of the present disclosure, the mutual capacitance of the telecommunications cable 100 is less than 5.6 nanoFarads per 100 meters at 1000 Hz. In another embodiment of the present disclosure, the telecommunications cable 100 has any other suitable value of the mutual capacitance. In general, the resistance unbalance is a measure of the difference in resistance between two conductors in a cabling system. In an embodiment of the present disclosure, the telecommunications cable 100 has the resistance unbalance of maximum 5 percent. In another embodiment of the present disclosure, the telecommunications cable 100 has any other suitable value of the resistance unbalance.

In general, the capacitance unbalance is a measure of difference in capacitance between two conductors in a cabling system. In an embodiment of the present disclosure, the capacitance unbalance of the telecommunications cable 100 is 330 picoFarads per 100 meter at 1000 Hz. In another embodiment of the present disclosure the telecommunications cable 100 has any other suitable value of capacitance unbalance. In general, the propagation delay is equivalent to an amount of time that passes between when a signal is transmitted and when it is received on the other end of a cabling channel. Propagation delay is 570 ns per 100 meters at 1 MHz. In general, the delay skew is a difference in propagation delay between any two conductor pairs within the same cable. In an embodiment of the present disclosure, the delay skew of the telecommunications cable 100 is less than 45 nanoseconds per 100 meters at 1 MHz. In another embodiment of the present disclosure, the telecommunications cable 100 has any other suitable value of the delay skew.

The telecommunications cable 100 enables increase in data transmission speed at high frequency. In general, the speed at which data is transmitted across a communication channel is referred to as data transmission speed. In general, the return loss is the measurement (in decibel) of the amount of signal that is reflected back toward the transmitter. In an embodiment of the present disclosure, the return loss of the telecommunications cable 100 is 20 dB at 1 MHz. In another embodiment of the present disclosure, the telecommunications cable 100 has any other suitable value of the return loss. In general, the insertion loss is the loss of signal power resulting from the material loss and is usually expressed in decibels. In an embodiment of the present disclosure, the telecommunications cable 100 has an insertion loss of 2.08 db at a frequency of 1 MHz at 20° C. In another embodiment of the present disclosure, the telecommunications cable 100 has any other suitable value of insertion loss.

In general, the propagation delay is equivalent to an amount of time that passes between when a signal is transmitted and when it is received on the other end of a cabling channel. In an embodiment of the present disclosure, the propagation delay for the telecommunications cable 100 is 570 nanoseconds at a frequency of 1 MHz. In another embodiment of the present disclosure the telecommunications cable 100 has any other suitable value of propagation delay. In general, the alien crosstalk is electromagnetic noise occurring in a telecommunications cable 100 running alongside one or more other signal-carrying cables. The term "alien" is used as alien crosstalk occurs between different cables in a group or bundle and not between individual wires or circuits within a single cable. In an embodiment of the present disclosure, the telecommunications cable 100 has an Power Sum alien Near End cross talk of 67 dB at a frequency of about 1 MHz. In another embodiment of the present disclosure, the telecommunications cable 100 has any other suitable value of alien cross talk. In general, crosstalk is an error condition describing the occurrence of a signal from one wire pair radiating to and interfering with the signal of another wire pair. In general, the input impedance is the ratio of the amplitudes of voltage and current of a wave travelling in one direction in the absence of reflections in the other direction. In an embodiment of the present disclosure, the input impedance of the telecommunications cable 100 is 100 ohms±15 ohm. In another embodiment of the present disclosure, the telecommunications cable 100 has any other suitable value of input impedance.

Each of the plurality of twisted pairs of electrical conductors extends substantially along the longitudinal axis of the telecommunications cable 100. In an embodiment of the present disclosure, each of the plurality of twisted pairs of insulated conductors is helically twisted along a length of the plurality of twisted pairs of electrical conductors. The plurality of twisted pairs of insulated conductors are helically twisted together to minimize the cross talk in the telecommunications cable 100. In an embodiment of the present disclosure, a number of the plurality of twisted pairs of electrical conductors is 4. In another embodiment of the present disclosure, the number of the plurality of twisted pairs of electrical conductors may vary. Each of the four twisted pair of insulated conductor includes two insulated conductors twisted together along a length of the insulated conductors.

Each insulated conductor of the plurality of twisted pairs of insulated conductors includes an electrical conductor and an insulation layer. In addition, each twisted pair of insulated conductor includes a first electrical conductor and a second electrical conductor. The first electrical conductor is surrounded by a first insulation layer. The second electrical conductor is surrounded by a second insulated layer. Similarly, each of the four twisted pair conductors includes a first electrical conductor surrounded by a first insulation layer and a second electrical conductor surrounded by a second insulated layer. Each of the plurality of twisted pairs of insulated conductors has the same structure. Each electrical conductor is 23 or 24 American wire gauge (hereinafter AWG) conductor. In general, AWG is a standardized wire gauge system. The value of wire gauge indicates the diameter of the conductors in the cable.

The telecommunications cable 100 includes a plurality of electrical conductors 122*a-b*. The plurality of electrical conductors 122*a-b* extends substantially along the longitudinal axis of the telecommunications cable 100. The plurality of electrical conductors 122*a-b* is data transmission elements of the telecommunications cable 100. In general, electrical conductors are used in many categories of data transmission, telecommunication, electrical wiring, power generation, power transmission, power distribution, electronic circuitry, and the like. The plurality of electrical conductors 122*a-b* is of circular shape. In an embodiment of the present disclosure, the plurality of electrical conductors 122*a-b* is of any other suitable shape.

Each of the plurality of electrical conductors 122*a-b* is characterized by a diameter. The diameter of each of the plurality of electrical conductors 122*a-b* lies in the range of about 0.48 millimeters to 0.62 millimeters. In an embodiment of the present disclosure, the diameter of each of the plurality of electrical conductor 122 is 0.58 millimeters. In another embodiment of the present disclosure, the diameter of each of the plurality of electrical conductors 122*a-b* lies in any other suitable range. Each of the plurality of electrical conductors 122*a-b* is made of copper. In an embodiment of the present disclosure, the plurality of electrical conductors 122*a-b* is made of any other suitable material.

The telecommunications cable 100 includes the insulation layer 124. The insulation layer 124 covers each of the plurality of electrical conductors 122*a-b*. In general, insulators are used in electrical equipment to support and separate electrical conductors. The electric current in the plurality of electrical conductors 122*a-b* cannot pass through the insulation layer 124. The insulation layer 124 provides electrical isolation for each of the plurality of electrical conductors 122*a-b*. The insulation layer 124 is characterized by a thickness. The thickness of the insulation layer 124 lies in the range of about 0.19 millimeters to 0.3 millimeters. In an embodiment of the present disclosure, the insulation layer 124 is of any other suitable thickness.

Further, the insulation layer 124 is made of polyolefin, polypropylene, fluoro ethylene propylene. In general, polyolefin is a polyethylene thermoplastic made from petroleum. The polyolefin is having a high mechanical strength and high electrical resistance. In an embodiment of the present disclosure, the insulation layer 124 is made of polypropylene. In another embodiment of the present disclosure, the insulation layer 124 is made of foamed polyolefin. In yet another embodiment of the present disclosure, the insulation layer 124 is made of polyolefin. In yet another embodiment of the present disclosure, the insulation layer 124 is made of fluoropolymer. In yet another embodiment of the present disclosure, the insulation layer 124 is made of combination of some or all of the certain materials. The certain materials include high density polyethylene, polypropylene, foamed polyethylene and fluoropolymer. In yet another embodiment of the present disclosure, the insulation layer 124 is made of any other suitable material.

The telecommunications cable 100 includes the separator 126. The separator 126 lies substantially along the longitudinal axis of the telecommunications cable 100. The separator 126 is placed at a center of the telecommunications cable 100. The center of the separator 126 lies on the longitudinal axis of the of the telecommunications cable 100. The separator 126 separates each twisted pair of insulated conductors from the rest of the twisted pairs of insulated conductors. In an embodiment of the present disclosure, the separator 126 separates a core of the telecommunications cable 100 into four sections. Each section includes a pair of twisted insulated conductor along a length of the telecommunications cable 100. The separator 126 is suitably designed such that it divides the core of the telecommunications cable 100 into plurality of separate sections of area. In an embodiment of the present disclosure, the separator 126 is of cross or plus shape. In an embodiment of the present disclosure, the separator 126 is of I shape. In another embodiment of the present disclosure, the separator 126 is of T shape. In yet another embodiment of the present disclosure, the separator 126 is of any other suitable shape.

The separator 126 divides the core of the telecommunications cable 100 into a plurality of separate area sections. In an embodiment of the present disclosure, the separator 126 divides the core of the telecommunications cable 100 into plurality of separate equal area sections. In another embodiment of the present disclosure, the separator 126 divides the core of the telecommunications cable 100 into plurality of separate unequal area sections. The separator 126 is uniform in shape along an entire length of the telecommunications cable 100.

The separator 126 is made up of low smoke zero halogen. In general, low smoke zero halogen is a type of plastic used in the wire and cable industry for improving performance of cables and wires. Low smoke zero halogen is custom compound designed to produce minimal smoke and no halogen during exposure to fire. In an embodiment of the present disclosure, the separator 126 is made of polyolefin. In another embodiment of the present disclosure, the separator 126 is made of foamed polyolefin. In yet another embodiment of the present disclosure, the separator 126 is made of polypropylene. In yet another embodiment of the present disclosure, the separator 126 is made of foamed polypropylene. In yet another embodiment of the present disclosure, the separator 126 is made of flame retardant poly vinyl chloride. In yet another embodiment of the present disclosure, the separator 126 is made of LSZH. In yet another embodiment of the present disclosure, the separator 126 is made of combination of some or all of the preselected materials. The preselected materials includes low smoke zero halogen, foamed polyethylene, polyethene, poly vinyl chloride and polypropylene. In yet another embodiment of the present disclosure, the separator 126 is made up of any other suitable material.

The telecommunications cable 100 includes plurality of area sections 128*a-d*. Each area of the plurality of area sections 128*a-d* corresponds to an area separated by the separator 126. The plurality of area sections 128*a-d* includes a first area section 128*a*, a second area section 128*b*, a third area section 128*c* and a fourth area section 128*d*. In an embodiment of the present disclosure, the plurality of area section 128*a-d* corresponds to any other suitable number of area sections. In an embodiment of the present disclosure, each of the plurality of area sections 128*a-d* is equal in cross sectional area. In another embodiment of the present disclosure, the cross sectional area of the plurality of area sections 128*a-d* is not equal. Each area section of the plurality of area sections 128*a-d* provides housing space for plurality of data transmission elements. Each area section of the plurality of area sections 128*a-d* includes one pair of twisted insulated conductors. In an embodiment of the present disclosure, each area section of the plurality of area sections 128*a-d* may include any other suitable number of pairs of twisted insulated conductors.

The insulation layer 124 of each of the plurality of electrical conductors 122*a-b* is colored. The insulation layer 124 of first electrical conductors 122*a* of the plurality of electrical conductors 122*a-b* in each of the plurality of area section 128*a-d* is of white color. The insulation layer 124 of the second electrical conductors 122*b* of the plurality of electrical conductors 122*a-b* in each of the plurality of area sections 128*a-d* is colored. The color of the insulation layer 124 of the second electrical conductors 122*b* of the plurality of electrical conductors 122*a-b* in each of the plurality of area section 128*a-d* is selected from a group. The group includes orange, blue, green and brown. In an embodiment of the present disclosure, the group includes any other suitable colors.

The telecommunications cable 100 includes the jacket 130. The jacket 130 includes a jacket body. The jacket body of the jacket 130 extends along the longitudinal axis of the telecommunications cable 100. The longitudinal axis of the telecommunications cable 100 passes through a geometrical center of the telecommunications cable 100. The jacket 130 surrounds the plurality of twisted pairs of insulated conductors extending substantially along the longitudinal axis of the telecommunications cable 100. The jacket 130 is an outer layer of the telecommunications cable 100. The jacket 130 is the protective outer covering for the telecommunication cable 100. The jacket 130 provides thermal insulation and electrical insulation to the telecommunications cable 100. The jacket 130 provides mechanical protection to the telecommunications cable 100. The jacket 130 protects the telecommunications cable 100 from moisture, water, insects, abrasion, magnetic fields, radiations and the like.

The jacket 130 is made of low smoke zero halogen. In an embodiment of the present disclosure, the jacket 130 is made of poly vinyl chloride. In another embodiment of the present disclosure, the jacket 130 is made of polyolefin. In yet another embodiment of the present disclosure, the jacket 130 is made of thermoplastic polyurethane. In yet another embodiment of the present disclosure, the jacket 130 is made of any other suitable material.

The jacket 130 includes the first surface 132*a* and the second surface 132*b*. The first surface 132*a* is an internal portion of the jacket 130. The first surface 132*a* surrounds the core of the telecommunications cable 100. The second surface 132*b* is an external surface of the jacket 130. The second surface 132*b* extends along the longitudinal axis of the telecommunications cable 100. The second surface 132*b* has a continuous circular cross section along the longitudinal axis of the telecommunications cable 100. The first surface 132*a* has a discontinuous circular cross section along the longitudinal axis of the telecommunications cable 100. The first surface 132*a* and the second surface 132*b* extend substantially along the longitudinal axis of the telecommunications cable 100. The first surface 132*a* and the second surface 132*b* are made of same material.

The first surface 132*a* and the second surface 132*b* are concentric to each other. The jacket 130 is characterized by a thickness. The thickness of the jacket 130 between the first surface 132*a* and the second surface 132*b* remains constant throughout the entire length of the telecommunications cable 100. The radial distance between the first surface 132*a* and the second surface 132*b* lies in the range of about 0.3 millimeter to 1 millimeter. In an embodiment of the present disclosure, the radial distance between the first surface 132*a* and the second surface 132*b* lies in any other suitable range.

The first surface 132*a* of the jacket 130 defines a plurality of first grooves 134*a* and a plurality of second grooves 134*b*. The plurality of first grooves 134*a* is directed radially outwardly from the longitudinal axis of the telecommunications cable 100. The plurality of second grooves 134*b* is directed radially outwardly from the longitudinal axis of the telecommunications cable 100. The plurality of first grooves 134*a* and the plurality of second grooves 134*b* lies substantially along the longitudinal axis of the telecommunications cable 100. The plurality of first grooves 134*a* has a cross-sectional shape selected from a group. The group consists of trapezoidal, sinusoidal, semicircular, square, rectangular, triangular and arched. The plurality of second grooves 134*b* has a M shape. In an embodiment of the present disclosure, the plurality of first grooves 134*a* and the plurality of second grooves 134*b* may have any other suitable cross-sectional shape.

Further, the number of plurality of first grooves 134*a* arranged around the first surface 132*a* lies in the range of 3 grooves to 12 grooves. In an embodiment of the present disclosure, the plurality of first grooves 134*a* arranged around the first surface 132*a* lies in any other suitable range. The plurality of second grooves 134*b* arranged around the first surface is in a number range of about 3 to 12. In an embodiment of the present disclosure, the plurality of second grooves 134*b* arranged around the first surface 132*a* lies in any other suitable range. The plurality of first grooves 134*a* and the plurality of second grooves 134*b* are alternatively arranged around the first surface 132*a*. In an embodiment of the present disclosure, the plurality of first grooves 134*a* and the plurality of second grooves 134*b* are arranged around the first surface 132*a* in any other suitable pattern. The plurality of second grooves 134*b* enable a M shape between the plurality of first grooves 134*a*.

In an embodiment of the present disclosure, a change in the number of plurality of first grooves 134*a* enables a change in the dielectric constant within the telecommunications cable 100. In an embodiment of the present disclosure, a change in the number of plurality of second grooves 134*b* enables a change in the dielectric constant within the telecommunications cable 100. The plurality of first grooves 134*a* and the plurality of second grooves 134*b* collectively include pointed edges towards the longitudinal axis of the telecommunications cable. The pointed edges enabled by the plurality of first grooves 134*a* and the plurality of second grooves 134*b* are equidistant from the longitudinal axis of the telecommunications cable 100. In an embodiment of the present disclosure, the pointed edges enabled by the plurality of first grooves 134*a* and the plurality of second grooves 134*b* are not equidistant from the longitudinal axis of the telecommunications cable 100.

The pointed edges of the plurality of first grooves 134*a* and the plurality of second grooves 134*b* are equidistant from the second surface 132*b*. The radial distance between the pointed edges of the plurality of first grooves 134*a* and the plurality of second grooves 134*b* and the second surface 132*b* lies in a range of about 0.4 millimeter to 1.8 millimeters. In an embodiment of the present disclosure, the radial distance between the pointed edges and the second surface 132*b* lies in any other suitable range. The plurality of first grooves 134*a* are characterized by a first circumferential arc length L1. The first circumferential arc length L1 is the width of each of the plurality of first grooves 134*a* along the circumference of the jacket 130. The first circumferential arc length L1 of the plurality of first grooves 134*a* lies in a range of about 1 millimeter to 6 millimeters. In an embodiment of the present disclosure, the first circumferential arc length L1 of the plurality of first grooves 134*a* lies in any other suitable range.

The plurality of first grooves 134*a* is arranged uniformly around the first surface 132*a*. The plurality of first grooves 134*a* is equally spaced about the circumference of the first surface 132*a*. The space between two consecutive grooves of the plurality of first grooves 134*a* is equal. In an embodiment of the present disclosure, the space between two consecutive grooves of the plurality of first grooves 134*a* may vary. The space between two consecutive grooves of the plurality of second grooves 134*b* is equal. In an embodiment of the present disclosure, the space between two consecutive grooves of the plurality of second grooves 134*b* may vary. The plurality of second grooves 134*b* is disposed at every interstitial position between the plurality of first grooves 134*a*. In an embodiment of the present disclosure, the plurality of second grooves 134*b* is disposed in any other suitable pattern around the plurality of first grooves 134*a*.

The plurality of first grooves 134*a* is designed such that a twisted pair of insulated conductors never enters into the cross section of plurality of first grooves 134*a*. The plurality of second grooves 134*b* is designed such that a twisted pair of insulated conductors never enters into the cross section of plurality of second grooves 134*b*. Further, each of the plurality of first grooves 134*a* is identical in shape and size. In an embodiment of the present disclosure, the size and shape of each of the plurality of first grooves 134*a* may vary. Further, each of the plurality of second grooves 134*b* is identical in shape and size. In an embodiment of the present disclosure, the size and shape of each of the plurality of second grooves 134*b* may vary.

The shape and cross sectional area of the plurality of first grooves 134*a* and the plurality of second grooves 134*b* is same throughout the entire length of the telecommunications cable 100. In an embodiment of the present disclosure, the shape and cross sectional area of the plurality of first grooves 134*a* and the plurality of second grooves 134*b* is different throughout the entire length of the telecommunications cable 100.

The plurality of first grooves 134*a* is characterized by a radial thickness. The radial thickness of each of the plurality of first grooves 134*a* is identical. The radial thickness of each of the plurality of first grooves 134*a* lies in a range of about 0.3 millimeter to 1 millimeter. In another embodiment of the present disclosure, the radial thickness of each of the plurality of first grooves 134*a* lies in any other suitable range. The plurality of first grooves 134*a* is characterized by a minimum interstitial space. The minimum interstitial space between the plurality of first grooves 134*a* defined by a second circumferential arc length L2. The second circumferential arc length L2 between the plurality of first grooves 134*a* lies in a range of about 0.2 millimeters to 2 millimeters. In an embodiment of the present disclosure, the second circumferential arc length L2 between the plurality of first grooves 134*a* lies in any other suitable range.

The telecommunications cable 100 includes the ripcord 136. The ripcord 136 is present inside the core of the telecommunications cable 100. The ripcord 136 lies substantially along the longitudinal axis of the telecommunications cable 100. The ripcord 136 facilitates stripping of the jacket 130. In an embodiment of the present disclosure, the telecommunications cable 100 includes more number of ripcords. In an embodiment of the present disclosure, the ripcord 136 is made of nylon based twisted yarns. In another embodiment of the present disclosure, the ripcord 136 is made of polyester based twisted yarns. In yet another embodiment of the present disclosure, the ripcord 136 is made of any other suitable material.

The telecommunications cable 100 is characterized by a first diameter and a second diameter. The first diameter is diameter of the first surface 132*a* of the cable jacket 130 of the telecommunications cable 100. The first diameter of the telecommunications cable 100 lies in the range of about 4 millimeters to 8 millimeters. In an embodiment of the present disclosure, the first diameter of the telecommunications cable 100 lies in any other suitable range. The second diameter is the diameter of the second surface 132*a* of the cable jacket 130 of the telecommunications cable 100. The second diameter of the telecommunications cable 100 lies in the range of about 5 millimeters to 9 millimeters. In an embodiment of the present disclosure, the second diameter of the telecommunications cable 100 lies in any other suitable range.

The present disclosure is significant over the prior art. The telecommunications cable provides protection against alien cross talk from surrounding cables at all frequency ranges. The telecommunications cable consumes less material as compared to cables with round shape similar thickness jacket. The telecommunications cable with increased air gap enables an improvement in electrical properties. The telecommunications cable has structural elements that enable improvement in overall installation efficiency. The telecommunications cable increases the data transmissions speed.

The foregoing descriptions of pre-defined embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

While several possible embodiments of the disclosure have been described above and illustrated in some cases, it should be interpreted and understood as to have been presented only by way of illustration and example, but not by limitation. Thus, the breadth and scope of a preferred embodiment should not be limited by any of the above-described exemplary embodiments.

What is claimed is:

1. A jacket for use in a telecommunications cable, the jacket comprising:

a jacket body extending along a longitudinal axis passing through a geometrical center of the telecommunications cable, wherein the jacket body comprises:

a first surface surrounding a core region of the telecommunications cable, wherein the first surface defines a plurality of first grooves extending radially outwardly from the longitudinal axis of the telecommunications cable and a plurality of second grooves extending radially outwardly from the longitudinal axis of the telecommunications cable and disposed at an interstitial position between the plurality of first grooves, wherein each of the plurality of first grooves is defined by a first circumferential arc length L1 in a range of about 1 millimeter to 6millimeters, wherein the interstitial position between the plurality of first grooves is defined by a second circumferential arc length L2 in a range of about 0.2millimeters to 2 millimeters and wherein each of the plurality of first grooves has a radial thickness in a range of about 0.3 millimeters to 1 millimeter, wherein the plurality of second grooves has a M shape; and a second surface extending along the longitudinal axis of the telecommunications cable and disposed in a spaced relation to the first surface, wherein the second surface is disposed at a radially outwardly position and at a radial distance of at least 0.3 millimeters from the first surface, wherein a radial distance between pointed edges of the plurality of first grooves and the plurality of second grooves and a second surface lies in a range of about 0.4 millimeter to 1.8millimeters, wherein the jacket is made of a material selected from a group consisting of polyvinyl chloride, polyolefin, low smoke zero halogen, low smoke flame retardant zero halogen and thermoplastic polyurethane, wherein the jacket has a first diameter in a range of about 4 millimeters to 8 millimeters, wherein the jacket has a second diameter in a range of about 5 millimeters to 9 millimeters.

2. The jacket as recited in claim 1, wherein the plurality of first grooves has a cross-sectional shape selected from a group consisting of sinusoidal, semicircular, square, rectangular, trapezoidal and arched.

3. The jacket as recited in claim 1, wherein the plurality of first grooves arranged around the first surface is in a number range of about 3 to 12.

4. The jacket as recited in claim 1, wherein the plurality of second grooves arranged around the first surface is in a number range of about 3 to 12.

5. A telecommunications cable comprising:

a plurality of twisted pairs of insulated conductors extending substantially along a longitudinal axis of the telecommunications cable, wherein each of the plurality of twisted pairs of insulated conductors comprises:

at least one electrical conductor, wherein the at least one electrical conductor extends along the longitudinal axis of the telecommunications cable; and at least one insulation layer surrounding the at least one electrical conductor, wherein the at least one insulation layer extends along the longitudinal axis of the telecommunications cable;

at least one separator for separating each twisted pair of insulated conductor of the plurality of twisted pairs of insulated conductors, wherein the separator extends along the longitudinal axis of the telecommunications cable;

a jacket comprising:

a jacket body extending along a longitudinal axis passing through a geometrical center of the telecommunications cable, wherein the jacket body comprises:

a first surface surrounding a core region of the telecommunications cable, wherein the first surface defines a plurality of first grooves extending radially outwardly from the longitudinal axis of the telecommunications cable and a plurality of second grooves extending radially outwardly from the longitudinal axis of the telecommunications cable and disposed at an interstitial position between the plurality of first grooves, wherein each of the plurality of first grooves is defined by a first circumferential arc length L1 in a range of about 1millimeter to 6 millimeters, wherein the interstitial position between the plurality of first grooves is defined by a second circumferential arc length L2 in a range of about 0.2 millimeters to 2 millimeters and wherein each of the plurality of first grooves has a pre-defined radial thickness in a range of about 0.3 millimeters to 1millimeter, wherein the plurality of second grooves has a M shape; and a second surface extending along a length of the telecommunications cable and disposed in a spaced relation to the first surface, wherein the second surface is disposed at a radially outwardly position and at a radial distance of at least 0.3millimeters from the first surface, wherein a radial distance between pointed edges of the plurality of first grooves and the plurality of second grooves and a second surface lies in a range of about 0.4 millimeter to 1.8 millimeters, wherein the jacket is made of a material selected from a group consisting of polyvinyl chloride, polyolefin, low smoke zero halogen, low smoke flame retardant zero halogen and thermoplastic polyurethane, wherein the jacket has a first diameter in a range of about 4 millimeters to 8millimeters, wherein the jacket has a second diameter in a range of about 5millimeters to 9 millimeters; and one or more ripcords inside the core of the telecommunications cable and and lying substantially along the longitudinal axis of the telecommunications cable, wherein the one or more ripcords facilitate stripping of the jacket.

6. The telecommunications cable as recited in claim 5, wherein the plurality of twisted pairs of insulated conductors are helically twisted together to minimize cross-talk.

7. The telecommunications cable as recited in claim 5, wherein the insulation layer is made of a material selected from a group consisting of polyolefin, polypropylene, foamed polyolefin, foamed polypropylene and fluoro-polymer.

8. The telecommunications cable as recited in claim 5, wherein the separator is made of a material selected from a group consisting of foamed polyolefin, polyolefin, solid or foamed polypropylene, LSZH and flame retardant polyvinyl chloride.

9. The telecommunications cable as recited in claim 5, wherein the at least one electrical conductor is defined with a diameter in a range of 0.48 millimeters and 0.62millimeters.

10. The telecommunications cable as recited in claim 5, wherein the at least one insulation layer is defined with a thickness in a range of 0.19 millimeters and 0.3millimeters.

* * * * *